US006057640A

United States Patent [19]

Aibara

[11] Patent Number: 6,057,640

[45] Date of Patent: May 2, 2000

[54] SHADOW MASK FOR COLOR CATHODE RAY TUBE WITH SLOTS SIZED TO IMPROVE MECHANICAL STRENGTH AND BRIGHTNESS

[75] Inventor: Nobumitsu Aibara, Shiga, Japan

[73] Assignee: NEC Corporation, Japan

[21] Appl. No.: 08/898,818

[22] Filed: Jul. 23, 1997

[30] Foreign Application Priority Data

Jul. 24, 1996 [JP] Japan ..... 8-194443

[51] Int. Cl.[7] ..... H01J 29/50

[52] U.S. Cl. ..... 313/403; 313/402

[58] Field of Search ..... 362/402, 403, 362/407, 404

[56] References Cited

U.S. PATENT DOCUMENTS

| | | | |
|---|---|---|---|
| 3,707,640 | 12/1972 | Lerner | 313/85 |
| 4,751,424 | 6/1988 | Tong | 313/402 |
| 5,523,647 | 6/1996 | Kawamura et al. | 313/407 |

FOREIGN PATENT DOCUMENTS

| | | |
|---|---|---|
| 2717295 | 4/1977 | Germany . |
| 2906611 | 2/1979 | Germany . |
| 52-4859 | 1/1977 | Japan . |

OTHER PUBLICATIONS

Michihiko INABA, et al., Development of an Invar (Fe–36Ni) Shadow Mask for Color Cathode Ray Tubes, Oct. 18, 1988, pp. 1721–1729.

*Primary Examiner*—Nimeshkumar D. Patel
*Assistant Examiner*—Michael J. Smith
*Attorney, Agent, or Firm*—Ostrolenk, Faber, Gerb & Soffen, LLP

[57] ABSTRACT

There is provided a shadow mask for a cathode ray tube, including a plate having a first surface and a second surface. The plate is formed with at least one line of slots between which bridge portions are formed, each slot being spaced away from adjacent slots by a predetermined pitch P. The bridge portions are defined by a first length at the first surface of the plate and a second length at the second surface of the plate, the first and second lengths being determined so that a factor R is in the range of 5% to 15%, wherein the factor R is defined as a ratio of the smaller of the first and second lengths, to the predetermined pitch P. By setting the factor R in the range of 5% to 15%, it is possible to enhance the mechanical strength of the shadow mask without deterioration of brightness characteristic of the shadow mask.

7 Claims, 6 Drawing Sheets

SHADOW MASK FOR COLOR CATHODE RAY TUBE WITH SLOTS SIZED TO IMPROVE MECHANICAL STRENGTH AND BRIGHTNESS

BACKGROUND OF THE INVENTION

1. Field of the Invention

The invention relates to a shadow mask used for a color cathode ray tube (CRT), and more particularly to a shadow mask being formed with a plurality of slots between which bridge portions are formed, which shadow mask is capable of having enhanced strength without deterioration of its brightness characteristics.

2. Description of the Related Art

FIG. 1 illustrates a widely used color cathode ray tube (hereinafter, a cathode ray tube is referred to simply as "CRT"). The illustrated color CRT includes a tube 1*a* having a face panel 1 at its front and a necked portion 1*b* at its rear, a fluorescent screen 2 formed on an inner surface of the face panel 1*a* and comprising stripe-shaped fluorescent films for blue (B), green (G) and red (R), and black matrix films, a mask frame 3 supported in the tube 1 in facing relation to the face panel 1*a,* a shadow mask 14 formed with a plurality of slots 15, an electron gun 8 disposed in necked portion 1*b* of the tube 1, and a deflection yoke 10 disposed outside around the necked portion 1*b*.

The electron gun 8 emits three electron beams 9 (only one of them is illustrated in FIG. 1), which are deflected by a horizontal magnetic field and a vertical magnetic field both generated by the deflection yoke 10 to thereby scan the fluorescent screen 2 with the thus deflected electron beams 9 through the shadow mask 14 having a plurality of the slots 15. The electron beams 9 impinge upon the strip-shaped fluorescent films for associated colors to thereby excite the fluorescent screen and cause the fluorescent screen to emit light. As a result, a certain color image is constituted on the fluorescent screen 2.

FIG. 2 is a partially enlarged partial view of the shadow mask 14, and FIG. 3 includes a partial enlarged plan view of a line of slots and a cross-sectional view thereof as viewed in a direction indicated with the line III—III. As illustrated in FIG. 2, the shadow mask 14 has a plurality of the rectangular slots 15 arranged in lines. The slots 15 in each line are vertically arranged, and are spaced away from adjacent ones by a pitch Pv, for instance, in the range of 0.2 mm to 1.0 mm. The slot lines are horizontally arranged in parallel, and between the slot lines are formed connections 17 having a constant width. Thus, the slot lines are equally, horizontally spaced away from one another.

Between the slots 15 in each line are formed bridge portions 16. In other words, the slots 15 are partitioned by the bridge portions 16. Each of the bridge portions 16 has a cross-section as illustrated in FIG. 3. Specifically, a cross-sectional area at of the bridge portion 16 is defined with a first area 16*a* at a first surface 14*a* of the shadow mask 14, increases in a thickness-wise direction of the shadow mask 14 up to a maximum cross-sectional area at 16*c,* and decreases in said thickness-wise direction down to a second area at 16*b* at a second surface 14*b* of the shadow mask 14. As illustrated in FIG. 3, the cross-section of the bridge portion 16 increases in an inwardly arcuate manner from the first area 16*a* to the maximum area 16*c,* and decreases in an inwardly arcuate manner from the maximum area 16*c* to the second area 16*b*. Herein, the first surface 14*a* of the shadow mask means a surface facing the fluorescent screen 2, and the second surface 14*b* of the shadow mask 14 means a surface facing the electron gun 8.

The mechanical strength of the shadow mask is defined by the bridge portions 16 formed vertically between the slots 15 and the connections 17 formed between the slot lines. The shadow mask 14 is readily broken by a bending force acting to horizontally bend the shadow mark 14. Hence, it is quite important for the bridge portions 16 to have sufficient mechanical strength.

The shadow mask 14 is in general made from a thin steel plate made of invar material, and the slots 15 are formed by forming resist patterns defining rectangular openings therein on the first and second surfaces 14*a* and 14*b* of the shadow mask 14, and etching the shadow mask 14 both at the first and second surfaces 14*a* and 14*b*. The rectangles defined by the resist patterns have a longer side in a vertical direction V and a shorter side in a horizontal direction H. The slots 15 have a common length L in the vertical direction V, and are arranged so that the bridge portions 16 formed between the slots 15 in a certain slot line are disposed at the vertical center of the slots 15 in the adjacent slot line.

Since the bridge portions 16 do not allow the electron beams 9 to pass therethrough, the bridge portions 16 form shadows on the fluorescent screen 2. The thus formed shadows deteriorate the brightness characteristic of the shadow mask 14. In addition, with electron beams 9 that are designed to have a smaller spot diameter, an even greater difference in brightness on the fluorescent screen 2 occurs with the result that images constituted on the fluorescent screen 2 are significantly influenced by Moiré fringes.

If the pitch Pv between the adjacent slots 15 were kept constant, while making the length L of the slots 15 greater to thereby cause the slots 15 to have a greater opening area, the shadow mask 14 could have a greater ratio of the opening area to the entire area thereof to thereby ensure brighter images on the fluorescent screen 2. That is, the brightness characteristic of the shadow mask 14 would be enhanced. However, since the pitch Pv would be kept constant, it would be unavoidable for a maximum width Bw of the bridge portions 16 to be made smaller, resulting in deterioration in the mechanical strength of the shadow mask 14 against a bending force acting to horizontally bend the shadow mask 14.

On the other hand, if the maximum width Bw of the bridge portions 16 were made greater, it would be unavoidable for the length L of the slots 15 to be made smaller. This would enhance the mechanical strength of the shadow mask 14, but at the same time would deteriorate the brightness characteristic of the shadow mask 14.

SUMMARY OF THE INVENTION

In view of the foregoing problem of the prior shadow mask, it is an advantageous feature of the present invention to provide a shadow mask for a CRT, which is has enhanced mechanical strength without the brightness characteristic thereof being deteriorated.

There is provided a shadow mask for a cathode ray tube, including a plate having a first surface and a second surface, the plate being formed with at least one line of slots between which bridge portions are formed, each slot being spaced away from adjacent slots by a predetermined pitch P, the bridge portions being defined by a first length at the first surface of the plate and a second length at the second surface of the plate, the first and second lengths being determined by a factor R where R is defined as a ratio of a common length between the first and second length when viewed in a direction perpendicular to a longitudinal direction of the line of slots, to the predetermined pitch P.

It is preferable that the factor R is in the range of 5% to 15% both inclusive. It is also preferable that the pitch P is equal to or smaller than 0.3 mm and the first and second lengths are in the range of 0.005 mm to 0.03 mm both inclusive.

The above and other advantageous features of the present invention will be made apparent from the following description made with reference to the accompanying drawings, in which like reference characters designate the same or similar parts throughout the drawings.

DESCRIPTION OF A PREFERRED EMBODIMENT

Figure 1:
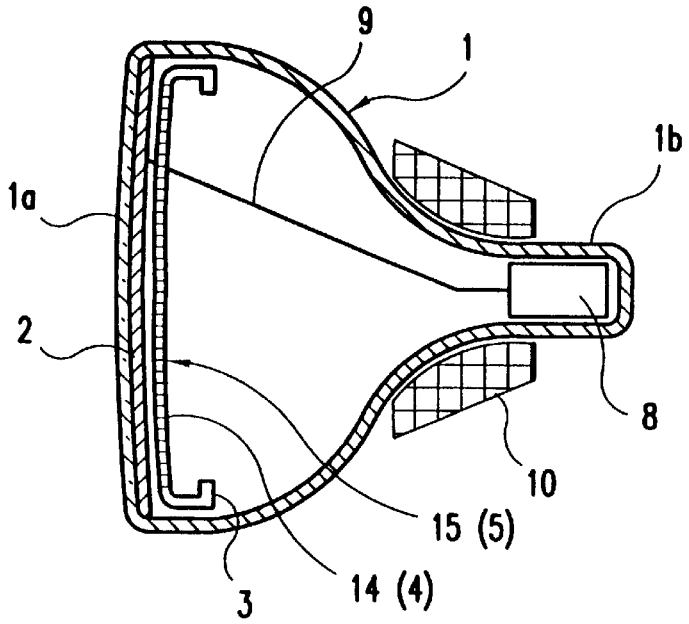
FIG. 1 PRIOR ART
FIG. 1 is a cross-sectional view illustrating a color cathode ray tube.
Figure 2:
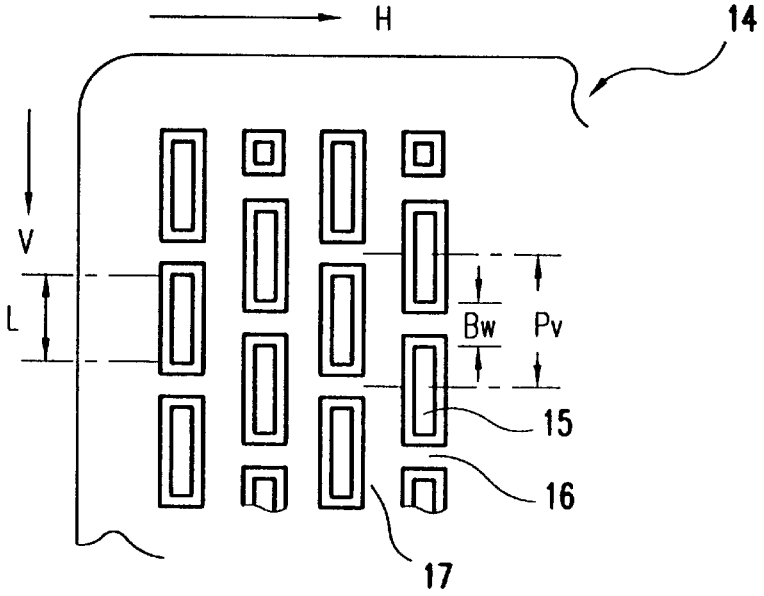
FIG. 2 PRIOR ART
FIG. 2 is a partial plan view illustrating a conventional shadow mask having a plurality of slots.
Figure 3:
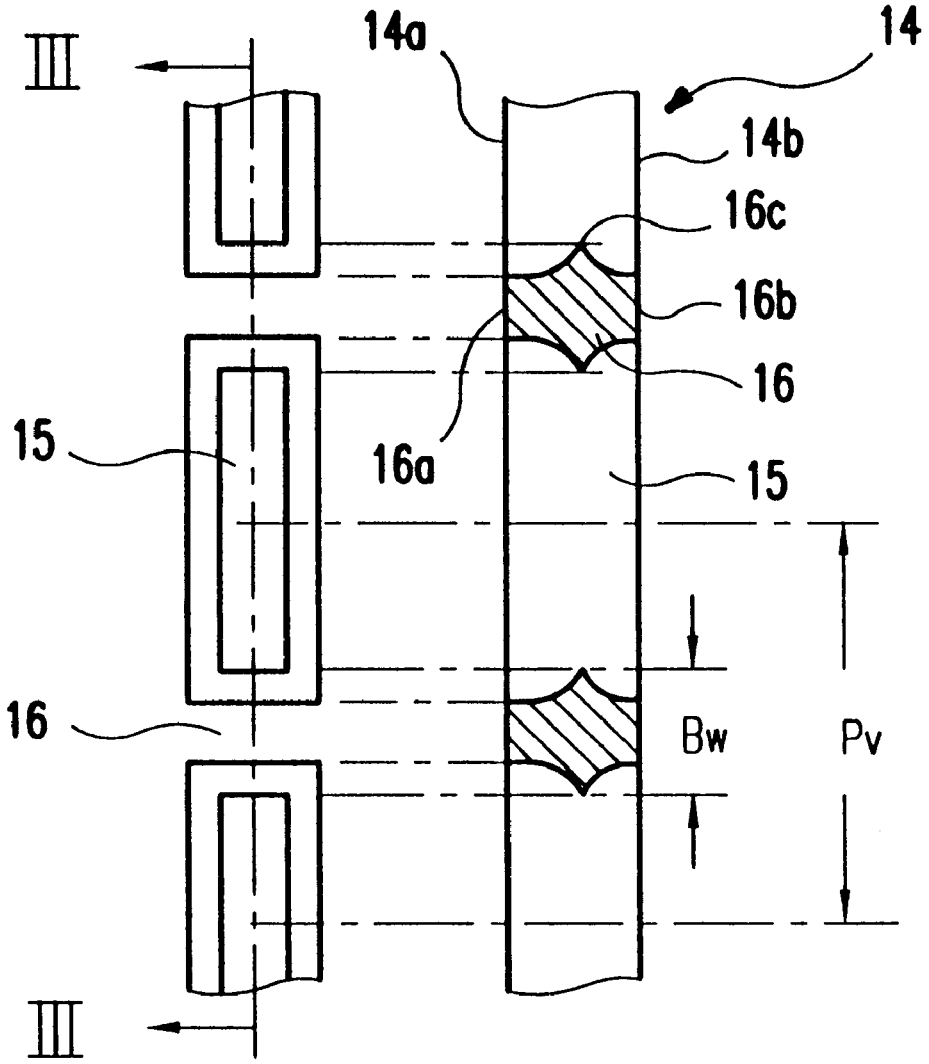
FIG. 3 PRIOR ART
FIG. 3 is an enlarged partial view and a partial, cross-sectional view of the slots of the shadow mask illustrated in FIG. 2.
Figure 4:
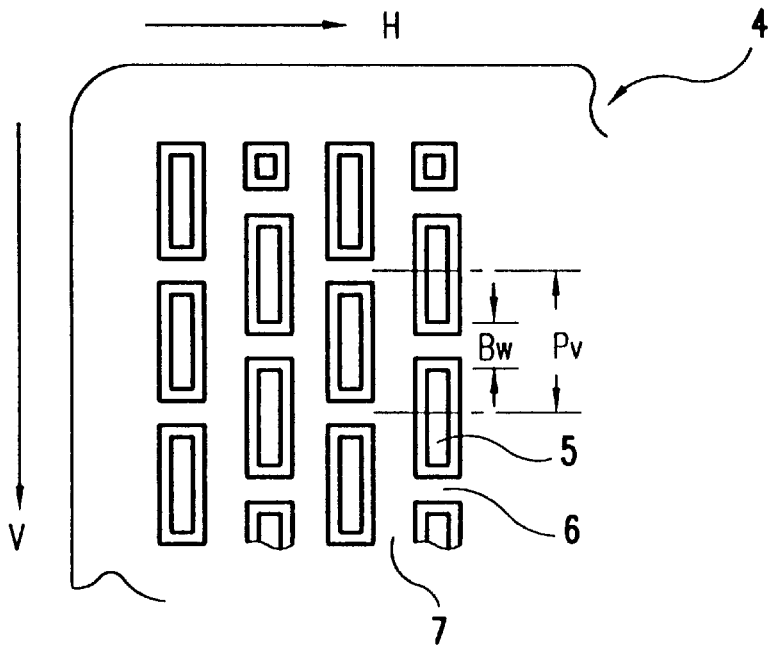
FIG. 4 is a partial plan view illustrating a shadow mask in accordance with an embodiment of the invention.

FIG. 4 illustrates a shadow mask 4 in accordance with a preferred embodiment. The illustrated shadow mask 4 includes a plurality of rectangular slots 5 arranged in lines. The slots 5 in each line are vertically arranged, and are spaced away from adjacent ones by a pitch Pv, for instance, in the range of 0.2 mm to 0.5 mm. Each of the rectangular slots 5 has a longer side in a vertical direction V and a shorter side in a horizontal direction H. The slot lines are horizontally arranged in parallel, and between the slot lines are formed connections 7 having a constant width. Thus, the slot lines are equally, horizontally spaced away from one another.

Figure 5:
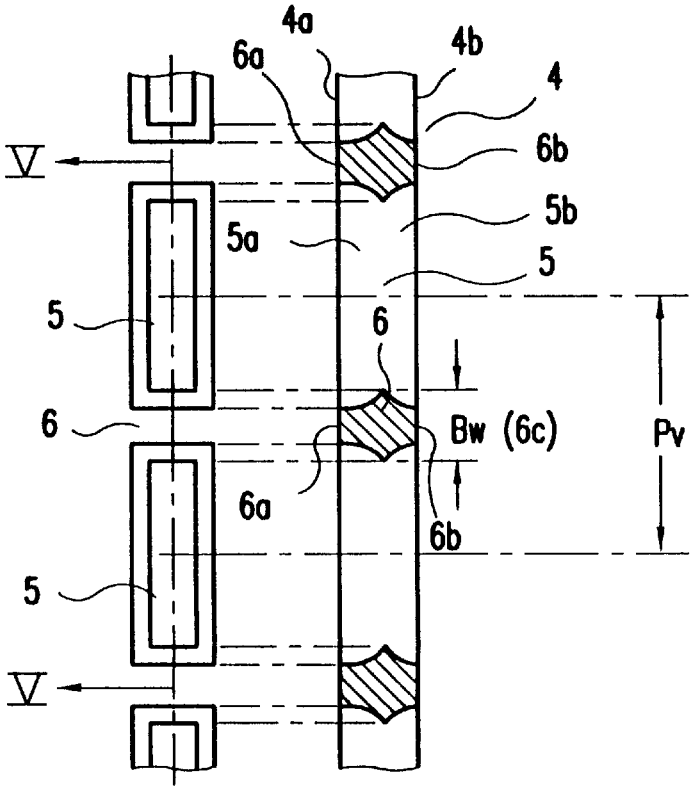
FIG. 5 is an enlarged partial view and a partial, cross-sectional view of the slots of the shadow mask illustrated in FIG. 4.

Between the slots 5 in each line are formed bridge portions 6. In other words, the slots 5 are partitioned by the bridge portions 6. Each of the bridge portions 6 has a cross-section as illustrated in FIG. 5. Specifically, a cross-sectional area of the bridge portion 6 is defined with a first area 6*a* at a first surface 4*a* of the shadow mask 4, increasing in a thickness-wise direction of the shadow mask 4 up to a maximum cross-sectional area 6*c*, and decreasing in a thickness-wise direction down to a second area 6*b* at a second surface 4*b* of the shadow mask 4. As illustrated in FIG. 5, the cross-section of the bridge portion 6 increases in an inwardly arcuate manner from the first area 6*a* to the maximum area 6*c*, and decreases in an inwardly arcuate manner from the maximum area 6*c* to the second area 6*b*. Herein, the first surface 4*a* of the shadow mask 4 means a surface facing the fluorescent screen 2, and the second surface 4*b* of the shadow mask 4 means a surface facing the electron gun 8.

The shadow mask 14 is in general made from a thin steel plate composed of invar material. The slots 15 are formed by the steps of forming resist patterns defining rectangular openings therein at the first and second surfaces 4*a* and 4*b* of the shadow mask 4, and etching the shadow mask 4 both at the first and second surfaces 4*a* and 4*b*. The rectangles defined by the resist patterns have a longer side in the vertical direction V and a shorter side in the horizontal direction H. The slots 5 have a common length L measured in the vertical direction V, and are arranged so that the bridge portions 6 formed between the slots 5 in a certain slot line are disposed at the vertical center of the slots 5 in the adjacent slot line.

Figure 6:
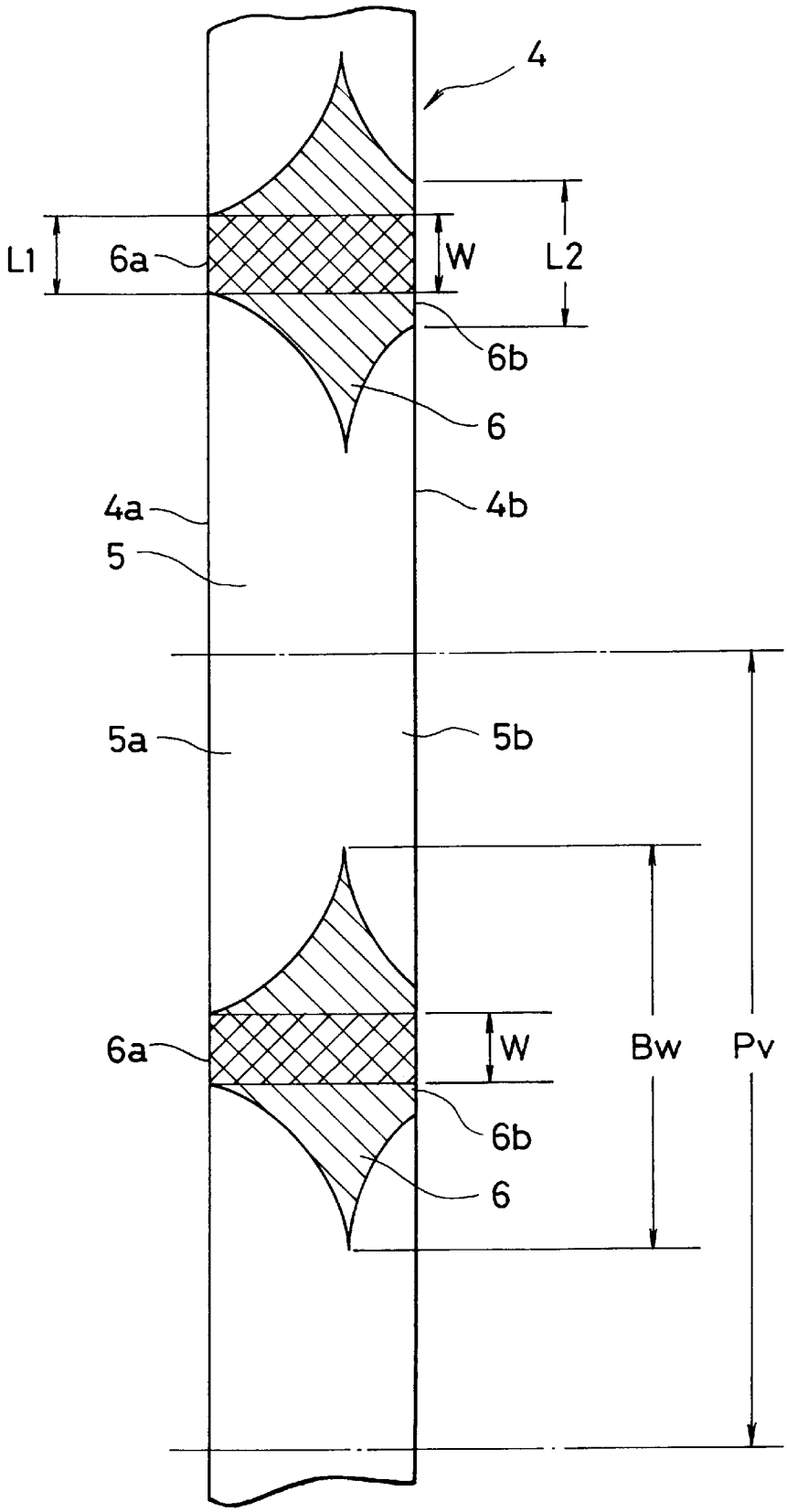
FIG. 6 is an enlarged partial view of the bridge portions and the slots illustrated in FIG. 5.

FIG. 6 is a partially enlarged view illustrating the bridge portions 6 and the slots 5 located between the bridge portions 6. By etching the shadow mask 4 at the first surface 4*a* thereof, there is formed a bigger slot portion 5*a*, and by etching the shadow mask 4 at the second surface 4*b*, there is formed a smaller slot portion 5*b*. The portions 5*a* and 5*b* are continuous with each other, and cooperate with each other to thereby constitute the slot 5. A non-etched area between the thus formed slots 5 in each of the slot lines forms the bridge portion 6. As illustrated in FIG. 6, the bigger hole portion 5*a* formed at the first surface 4*a* has an opening area different from that of the smaller hole portion 5*b* formed at the second surface 4*b*. Hence, the first and second areas 6*a* and 6*b* have different lengths in the vertical direction V. Supposed that the first area 6*a* has a length L1 and the second area 6*b* has a length L2, the length L2 is in general greater than the length L1 (L2>L1), because the smaller hole portion 5*b* has a smaller opening area than that of the bigger hole portion 5*a*. Thus, the first and second areas 6*a* and 6*b* have a common length W (i.e., the smaller of the length L1 and length L2) which is equal in this case to the length L1. As explained hereinbelow in detail, the mechanical strength of the shadow mask 4 against the bending force acting thereon to horizontally bend the shadow mask 4 is dependent on the common length W.

Figure 7A:
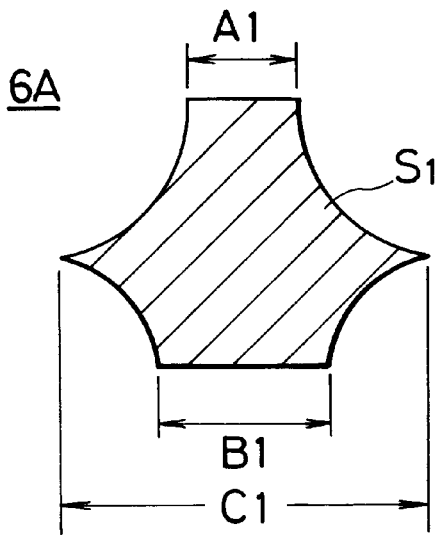
FIGS. 7A to 7C are enlarged cross-sectional views of various alternative bridge portions.
Figure 7B:
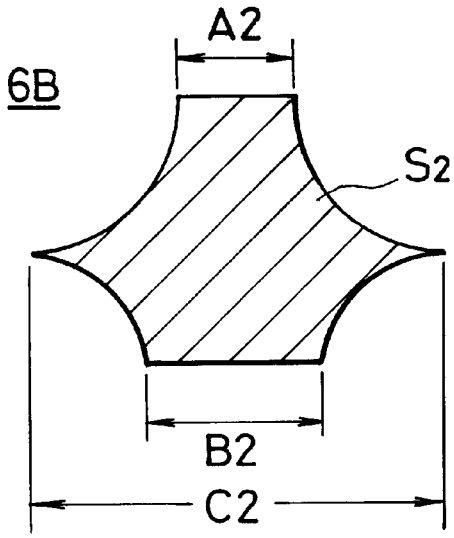
Figure 7C:
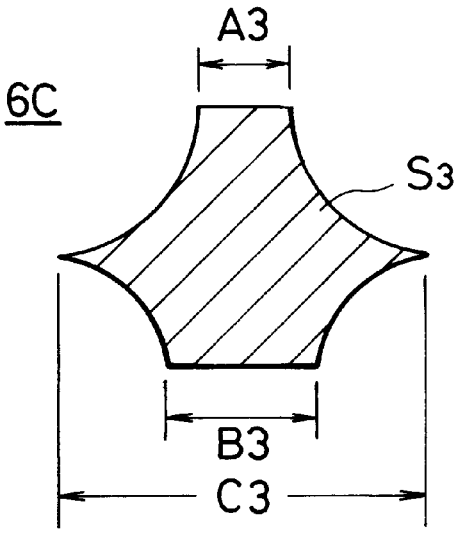

The inventor conducted experiments on the mechanical strength of the shadow mask 4. There were made three bridge portions 6A, 6B and 6C having cross-sections as illustrated in FIGS. 7A, 7B and 7C, respectively. The bridge portions 6A, 6B and 6C have the different length, measured in the vertical direction V, of the first area 6*a*, second area 6*b*, and maximum width 6*c*, as shown in Table 1.

TABLE 1

| | Bridge Portion 6A | Bridge Portion 6B | Bridge Portion 6C |
|---|---|---|---|
| First area 6a | A1 | A2 (=A1) | A3(<A1) |
| Second area 6b | B1 | B2(=B1) | B3(<B1) |
| Maximum width 6c | C1 | C2(>C1) | C3(=C1) |
| Cross-sectional area | S1 | S2(>S1) | S3(≈S1) |
| Mechanical strength | ○ | ○ | X |

In the Table 1, the total cross-sectional area S3 is slightly smaller than, but nearly equal to the cross-sectional area S1. Specifically, the measurements A1 to A3, B1 to B3, C1 to C3 are as follows.

| | | |
|---|---|---|
| A1 = 0.025 mm | B1 = 0.025 mm | C1 = 0.08 mm |
| A2 = 0.025 mm | B2 = 0.025 mm | C2 = 0.085 mm |
| A3 = 0.02 mm | B3 = 0.02 mm | C3 = 0.08 mm |

The shadow masks 4 each having the bridge portions 6A, 6B and 6C, respectively, were made by press working, and were subject to the mechanical strength test. The results were that the bridge portion 6A illustrated in FIG. 7A has almost the same mechanical strength as that of the bridge portion 6B illustrated in FIG. 7B, but the bridge portion 6C illustrated in FIG. 7C has a smaller mechanical strength than those of the other two bridge portions 6A and 6B.

It has been confirmed in view of the results of the experiments that the mechanical strength of the shadow mask 4 against the bending force to horizontally bend the shadow mask 4 is dependent more greatly on the lengths of the first and second areas 6*a* and 6*b* than on the maximum width 6*c*. This suggests that the mechanical strength of the shadow mask 4 is dependent principally on a common length or area W between the first and second areas 6*a* and 6*b,* and that it is preferable to make the common length W greater in order to enhance the mechanical strength of the shadow mask 4. On the other hand, if the maximum width 6*c* is made greater, the mechanical strength of the bridge portion 6 is enhanced only slightly. A further effect of making the maximum width 6*c* greater is that a ratio of the maximum width 6*c* to the pitch Pv is also made greater, with the result that it becomes more difficult for the electron beams 9 to pass through the shadow mask 4 due to the enlarged maximum width 6*c*. This results in significant deterioration in the brightness on the fluorescent screen 2.

As the common length W between the first and second areas 6*a* and 6*b* is made greater, the shadow mask 4 could have a greater mechanical strength. However, since the shadow mask 4 is formed by etching a thin plate, if the common length W is made greater, the maximum width 6*c* also becomes greater. Hence, a preferable range of the common length W has to be defined by a certain factor or factors so as to enhance the mechanical strength of the shadow mask 4 without deterioration in the brightness on the fluorescent screen 2. To this end, the inventor has focused on a ratio R defined as a ratio of the common length W between the first and second areas 6*a* and 6*b* to the pitch Pv between the slots 15. That is, the ratio R is defined as follows.

$$R=(W/Pv)\times 100[\%]$$

In order to find a preferable range of the ratio R, the inventor conducted experiments for obtaining a relation between the ratio R and the mechanical strength of the shadow mask 4, and a relation between the ratio R and the brightness on the fluorescent screen 2. There were prepared a plurality of shadow masks 4 having variations in the first area 6*a,* second area 6*b,* common length W and pitch Pv. The mechanical strength and the brightness were measured for each of the shadow masks. The results of the experiments are shown in Table 2. In Table 2, the mechanical strength MS of the shadow masks 4 and the brightness B on the fluorescent screen are indicated by a relative ratio, wherein a ratio 1 means the required mechanical strength or brightness. Hence, a ratio greater than 1 indicates sufficient mechanical strength or brightness, whereas a ratio smaller than 1 indicates insufficient mechanical strength or brightness. The shadow masks used in the experiments had a thickness of 0.12 mm.

TABLE 2

| | First area 6a | Second area 6b | Common length W | Pitch Pv | Ratio R [%] | MS | B |
|---|---|---|---|---|---|---|---|
| Sample 1 | 0.02 | 0.025 | 0.015 | 0.3 | 5 | 1.2 | 1.2 |
| Sample 2 | 0.015 | 0.02 | 0.01 | 0.25 | 4 | 0.8 | 1.35 |
| Sample 3 | 0.02 | 0.04 | 0.035 | 0.2 | 17.5 | 2.5 | 0.87 |

TABLE 2-continued

| | First area 6a | Second area 6b | Common length W | Pitch Pv | Ratio R [%] | MS | B |
|---|---|---|---|---|---|---|---|
| Sample 4 | 0.025 | 0.035 | 0.03 | 0.2 | 15 | 1.9 | 1.0 |
| Sample 5 | 0.027 | 0.035 | 0.02 | 0.2 | 10 | 1.65 | 1.07 |
| Sample 6 | 0.04 | 0.04 | 0.04 | 0.3 | 13.3 | 1.85 | 1.04 |
| Sample 7 | 0.05 | 0.07 | 0.04 | 0.2 | 20 | 2.8 | 0.8 |
| Sample 8 | 0.06 | 0.07 | 0.05 | 0.2 | 25 | 3.1 | 0.75 |
| Sample 9 | 0.08 | 0.07 | 0.06 | 0.2 | 33.3 | 3.7 | 0.55 |

Figure 8:
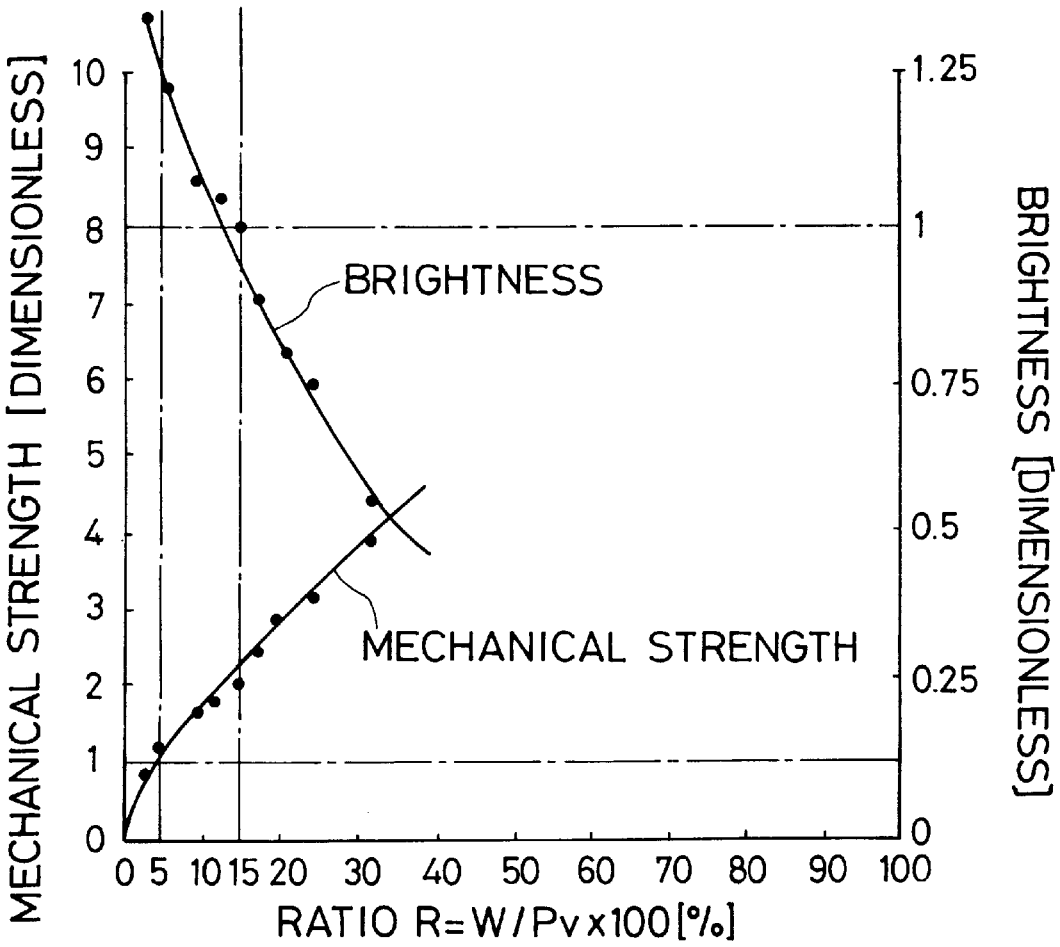
FIG. 8 is a graph showing a relation between the ratio R and the mechanical strength of the shadow mask, and a relation between the ratio R and the brightness of the shadow mask.

FIG. 8 illustrates the curves obtained by plotting the above listed results. As would be understood in view of FIG. 8, the ratios with respect to the mechanical strength and the brightness are both equal to or greater than 1, when the ratio R is in the range of 5% to 15% both inclusive. Thus, the preferable range of the ratio R is 5% to 15% for enhancing the mechanical strength of a shadow mask without deterioration in the brightness on a fluorescent screen.

Based on the above mentioned experiments, it has been secondarily confirmed that the shadow mask could have sufficient mechanical strength, if the first and second areas 6*a* and 6*b* have a length of at least 0.005 mm, on the condition that the pitch Pv is equal to or smaller than 0.3 mm. This is because that if the pitch Pv is made smaller than 0.3 mm, the number of bridge portions 6 is increased in inverse proportion thereto, ensuring the sufficient mechanical strength of the shadow mask 4. Considering that the dimensions of the shadow masks may vary, it would be necessary for the first and second areas 6*a* and 6*b* to have a length in the range of 0.005 mm to 0.03 mm in order to minimize the maximum width 6*c* of the bridge portions 6.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 8-194443 filed on Jul. 24, 1996 including specification, claims, drawings and summary is incorporated herein by reference in its entirety.

What is claimed is:

1. A shadow mask for a cathode ray tube, comprising a plate having a first surface and a second surface, said plate being formed with at least one line of slots between which bridge portions are formed, each slot being spaced away from adjacent slots by a predetermined pitch P, said bridge portions being defined by a first length at said first surface of said plate and a second length at said second surface of said plate, the first and second lengths being determined by a factor R, where R is defined as a ratio of a common length between said first and second lengths to said predetermined pitch P; and wherein said pitch P is equal to or smaller than 0.3 mm and said first and second lengths are equal to or greater than 0.005 mm.

2. The shadow mask as set forth in claim 1, wherein said first and second lengths are equal to or smaller than 0.03 mm.

3. A shadow mask for a cathode ray tube, comprising a plate having a first surface and a second surface, said plate being formed with at least one line of slots between which bridge portions are formed, each slot being spaced away from adjacent slots by a predetermined pitch P, said bridge portions being defined by a first length at said first surface of said plate and a second length at said second surface of said plate, the first and second lengths being determined so that a factor R is at least 5%, where R is defined as a ratio of a common length between said first and second lengths to said predetermined pitch P; and wherein said factor R is equal to or smaller than 15%.

4. A shadow mask for a cathode ray tube, comprising a plate having a first surface and a second surface, said plate being formed with at least one line of slots between which bridge portions are formed, each slot being spaced away from adjacent slots by a predetermined pitch P, said bridge portions being defined by a first length at said first surface of said plate and a second length at said second surface of said plate, the first and second lengths being determined so that a factor R is at least 5%, where R is defined as a ratio of a common length between said first and second lengths to said predetermined pitch P; and wherein said pitch P is equal to or smaller than 0.3 mm and said first and second lengths are equal to or greater than 0.005 mm.

5. The shadow mask as set forth in claim 4, wherein said first and second lengths are equal to or smaller than 0.03 mm.

6. The shadow mask as set forth in claim 3, wherein said pitch P is equal to or smaller than 0.3 mm and said first and second lengths are equal to or greater than 0.005 mm.

7. The shadow mask as set forth in claim 6, wherein said first and second lengths are equal to or smaller than 0.03 mm.

* * * * *